US007017192B2

(12) United States Patent
Jackanich et al.

(10) Patent No.: US 7,017,192 B2
(45) Date of Patent: Mar. 28, 2006

(54) NOVELTY HAT

(75) Inventors: Patrick C. Jackanich, Houston, TX (US); Michael S. VanDerhei, Houston, TX (US)

(73) Assignee: The Motor-Head Project, Ltd., Houston, TX (US)

( * ) Notice: Subject to any disclaimer, the term of this patent is extended or adjusted under 35 U.S.C. 154(b) by 191 days.

(21) Appl. No.: 10/603,089

(22) Filed: Jun. 25, 2003

(65) Prior Publication Data

US 2005/0268376 A1 Dec. 8, 2005

(51) Int. Cl.
*A42B 1/00* (2006.01)

(52) U.S. Cl. ..... 2/209.13; 2/195.1; D2/896; D2/872

(58) Field of Classification Search ..... 2/195.1, 2/200.1, 200.3, 171, 209.11, 209.12, 209.13; 446/27; 40/329
See application file for complete search history.

(56) References Cited

U.S. PATENT DOCUMENTS 1,247,415 A 11/1917 Lattimore
1,418,196 A * 5/1922 Neppell ..... 2/209.7
1,926,430 A 9/1933 Buescher et al.
2,497,527 A * 2/1950 Bacon ..... 446/27
2,727,246 A 12/1955 Long
2,795,796 A * 6/1957 Ray ..... 2/206
4,991,235 A 2/1991 Warner
5,328,399 A 7/1994 Reynolds
D368,354 S 4/1996 Edwards, Jr.
D372,571 S 8/1996 Venditto, Jr.
5,665,458 A * 9/1997 Mahn, Jr. ..... 428/202
D390,433 S 2/1998 Miller
D393,536 S 4/1998 Buffer et al.
D406,437 S 3/1999 Tulleners
D407,536 S 4/1999 Segal
D411,906 S 7/1999 Ely et al.
D417,769 S 12/1999 Cauthen
D417,941 S 12/1999 Bass
6,012,174 A 1/2000 Rech et al.
D420,782 S 2/2000 Sandt et al.
D429,870 S 8/2000 Venditto, Jr.
6,374,419 B1 4/2002 Pietsch

* cited by examiner

*Primary Examiner*—John J. Calvert
*Assistant Examiner*—Alissa J. Tompkins
(74) *Attorney, Agent, or Firm*—Howrey LLP

(57) ABSTRACT

A novelty hat assembled from lightweight, flat foam members and shaped, for example, like a racecar. The novelty hat includes details, such as wheels, windshields, racecar number, and team logos, printed on flat laminated surfaces of the flat foam members. The flat foam members are designated to stack for storage or packaging, resulting in less volume and weight for shipping and distribution purposes.

19 Claims, 8 Drawing Sheets

NOVELTY HAT

FIELD OF THE INVENTION

This invention relates to novelty items, and more particularly to novelty hats.

BACKGROUND OF THE INVENTION

It is big business in the sports industry to sell and distribute novelty items that capitalize on fan enthusiasm. Sports novelty items not only sell as products themselves but also serve as collector items and excellent marketing tools. Many companies distribute free novelty items as a marketing technique to associate their product with the enjoyment of the sporting event experience. In order to be effective, the novelty item must accurately capture important aspects of the sporting event and provide high visibility marketing opportunities.

Motor sport racing is one of the most popular sports and a perfect environment for the selling and distributing of novelty items because racing fans in particular enjoy high quality collector items. Fans have begun wearing novelty items in the form of sports garments and paraphernalia as an enjoyable method of demonstrating their support and enthusiasm for their favorite driver or racing team. Headgear has become popular among fans and distributors because novelty hats are highly visible in the sporting stands and provide excellent marketing space for sponsors and companies looking to advertise.

A form of headgear popular among racing fans is the novelty hat shaped and designed like a racecar. Fans appreciate these racecar novelty hats because the hats provide welcomed shade as well as identifying fans with their favorite driver or racing team. Unfortunately, existing racecar novelty hats employ bulky single element construction that make the existing hats heavy, uncomfortable, problematic for detailed printing, and troublesome to distribute in a volume efficient manner.

An example of a traditional novelty hat for fans and companies is described in U.S. Design Pat. No. 393,536 issued to Buffer et al. This patent discloses a racecar hat formed of a single molded element, shaped like a racecar, and having an aperture in the bottom for resting on a fan's head. The curved surfaces and awkward shape have limited printing capabilities for placing designs, drivers, and details of racing teams and sponsors on the outside of the novelty hat.

Another example of a traditional novelty hat is described in U.S. Pat. No. 6,012,174, issued to Rech et al. The novelty hat of this patent is molded from solid foam and shaped like a racecar. The patent acknowledges that the coarse granular surface of foam makes the foam novelty hat difficult to paint or print. To overcome this problem, the novelty hat is covered with a smooth outer surface such that stickers and decals may be applied. However, detailed printing is still unavailable because of the lack of flat surfaces to print on.

Like other racecar novelty hats, the novelty hats taught by Buffer et al. and Rech et al. employ a bulky single element molded construction and do not collapse or disassemble for shipping and distribution. As such, traditional racecar novelty hats can be uncomfortable to wear and expensive to ship because of their heavy and bulky construction.

In general, novelty hats in the shape of racecars are not suitable for detailed printing of sponsor information and detailed vehicle characteristics on their outer surface because the uneven and curved surfaces of a racecar novelty hats make detailed printing impossible.

SUMMARY OF THE INVENTION

Accordingly, the present invention is directed to a novelty hat that substantially obviates one or more of the problems arising from the limitations and disadvantages of the related art.

The object and purpose of the present invention is to provide an economical and attractive novelty hat for distribution at motor sport events.

Another object and purpose of the present invention is to provide a novelty hat assembled out of inexpensive flat members, which stack and package easily for shipping and distribution.

Another object and purpose of the present invention is to provide a novelty hat enabling the packaged novelty hat to occupy significantly less volume than the assembled novelty hat.

Another object and purpose of the present invention is to provide a novelty hat that is significantly less weight than traditional single element construction novelty hats and therefore is more comfortable to wear and less expensive to ship.

Another object and purpose of the present invention is to provide a novelty hat constructed out of foam and capable of detailed printing on the outer surface of the novelty hat.

Another object and purpose of the present invention is to provide a novelty hat with detailed printing of sponsor information, detailed vehicle characteristics, or other information on the flat members before the novelty hat is assembled.

Another object and purpose of the present invention is to provide a thin layer or laminate on the flat members of the novelty hat for enabling enhanced printing.

Another object and purpose of the present invention is to provide a cloth laminate on the flat members for enabling photo quality printing on the novelty hat.

Additional features and advantages of the invention will be set forth in the description as follows, and in part will be apparent from the description or may be learned by practice of the invention. The objectives and other advantages of the invention will be realized and attained by the methods and apparatus particularly pointed out in the written description and claims hereof together with the appended drawings.

To achieve these and other advantages, and in accordance with the purposes of the invention, as embodied and broadly described, the invention is a novelty hat formed of flat members with fasteners connecting the flat members into the shape of a racecar or other racing vehicles. The flat members of the novelty hat package flat against each other, allowing the novelty hat to be shipped and distributed in a significantly reduced volume. The flat member construction also provides a lightweight novelty hat, which is comfortable to wear and less expensive to ship. Furthermore, because the flat members present a flat surface to print on, extremely detailed printing can be done on the flat members before the novelty hat is assembled. Cloth laminates or other thin layers may also be used on the flat members to enhance the print quality. For example, upon assembly, the racecar novelty hat will not only have the form of a racecar, but also will have the realistic details of a racecar printed onto the outside surface. Such details could include, but are not limited to, headlights, tires, windshields, roll bars, window netting, and drive shaft.

It is to be understood that both the foregoing general description and the following detailed description are exemplary and explanatory, and are intended to provide further explanation of the invention as claimed.

The accompanying drawings are included to provide a further understanding of the invention and are incorporated in and constitute a part of this specification, illustrating one embodiment of the invention. The drawings, together with the description, serve to explain the principles of the invention.

DETAILED DESCRIPTION OF THE DRAWINGS

Reference will now be made in detail to the present preferred embodiment of the invention, an example of which is illustrated in the accompanying drawings. The preferred embodiment is a novelty hat in the shape of a stock car racecar constructed out of flat members of foam. The details of a racecar are printed on the laminated surfaces of foam pieces before being die cut into shaped members and assembled into a novelty hat in the shape of a racecar. It will be obvious to one of ordinary skill in the art that the racecar shape of the preferred embodiment is of a representative nature and that the novelty hat disclosed in this invention applies to other racing vehicles like trucks and boats. Furthermore, novelty hats in the shape of automobiles, trucks, boats, or other vehicles may be formed.

Figure 1:
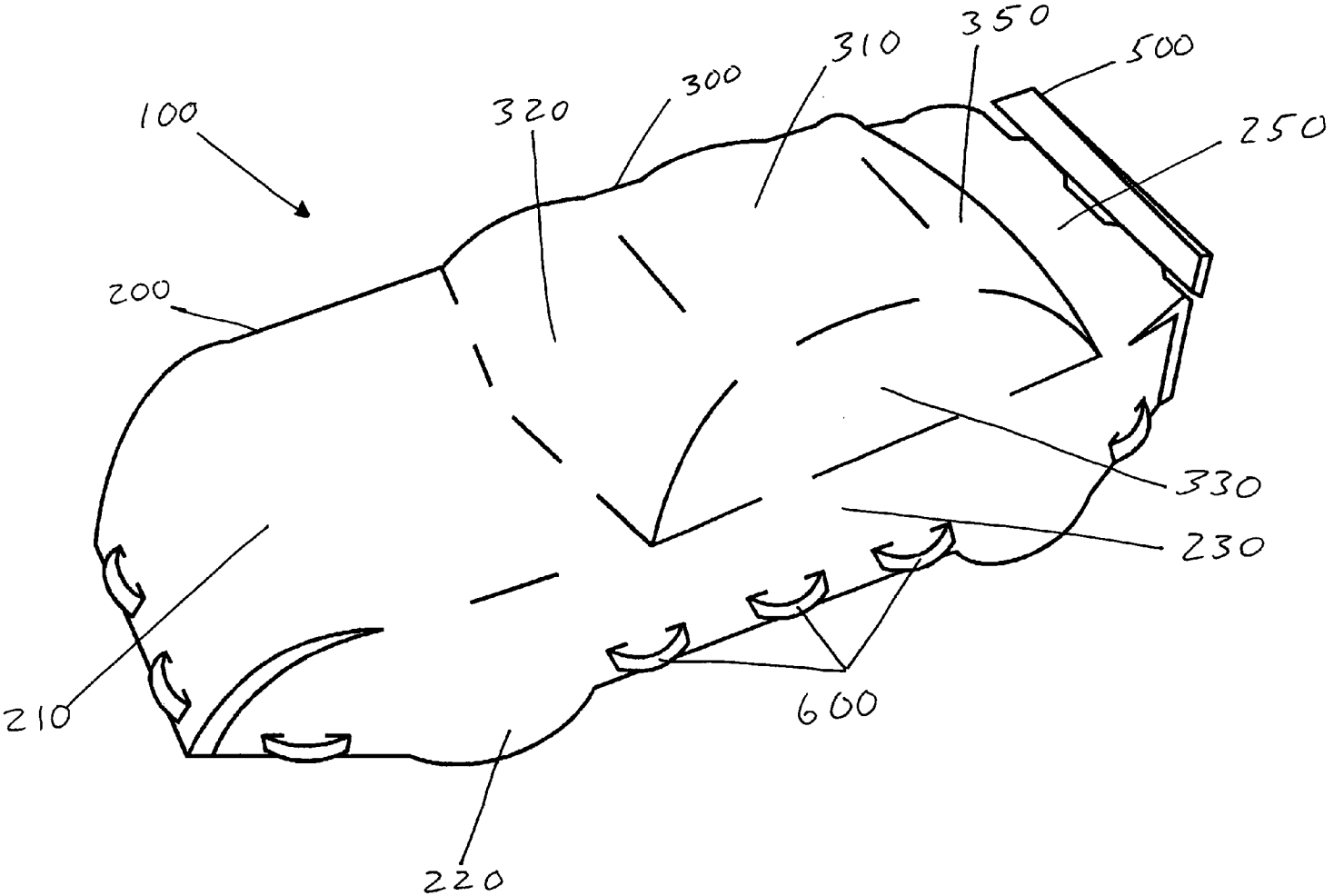
FIG. 1 is a perspective view of the assembled novelty hat.

The preferred embodiment of the novelty hat is shown in FIG. 1, and is designated generally by reference numeral 100. The novelty hat 100 resembles a stock car racing model and is formed from a body member 200, a top member 300 and a bottom member 400. Preferably, the novelty hat 100 also has a spoiler member 500 to give the racecar a more realistic look. The members 200, 300, 400, and 500 are all connected using fasteners 600. Although a stock car is used in the preferred embodiment for the shape of the novelty hat 100, many different makes and models of racecars or other vehicles may be formed.

Figure 2:
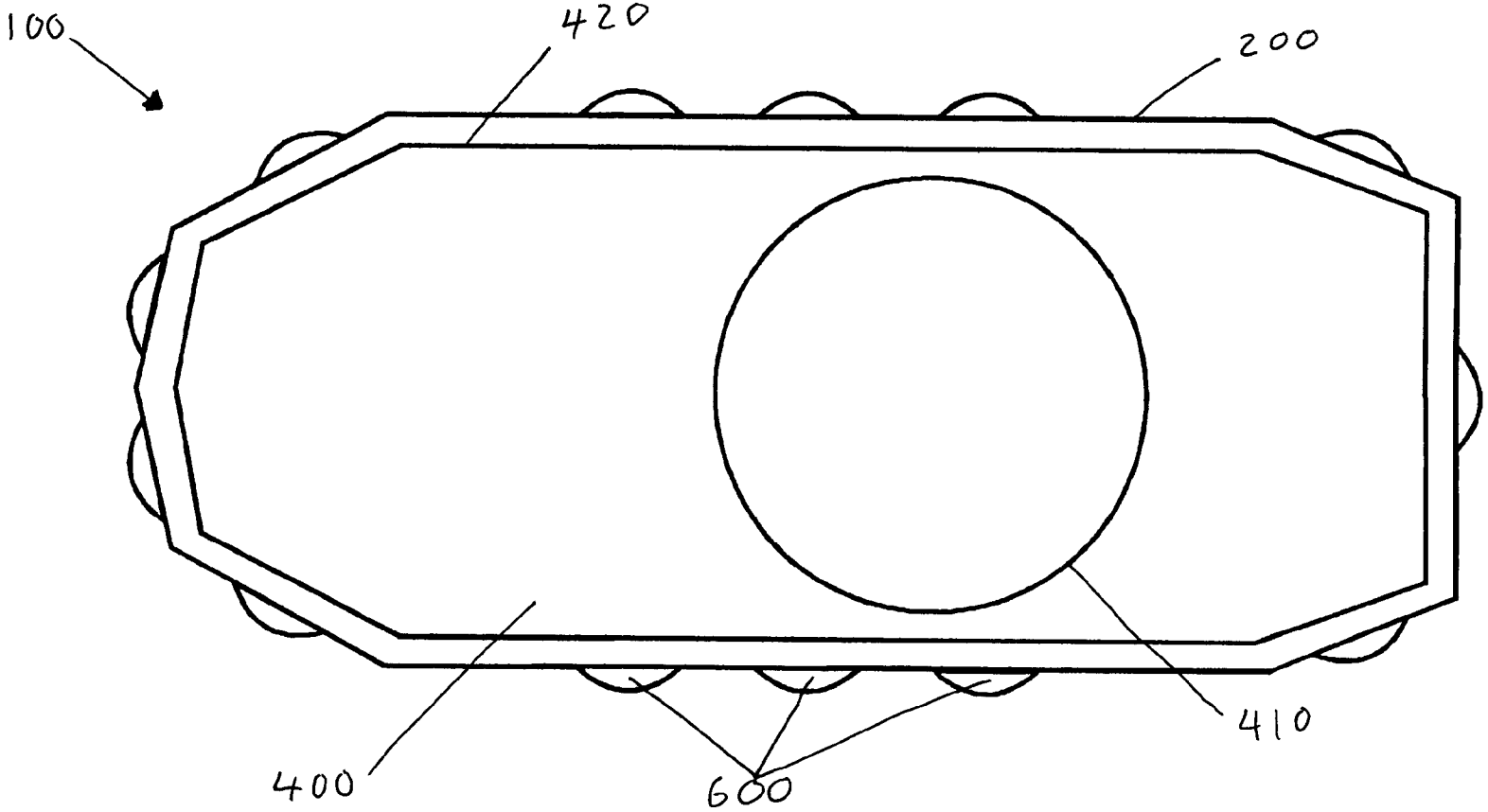
FIG. 2 is a plan view of the bottom of the assembled novelty hat.
Figure 3:
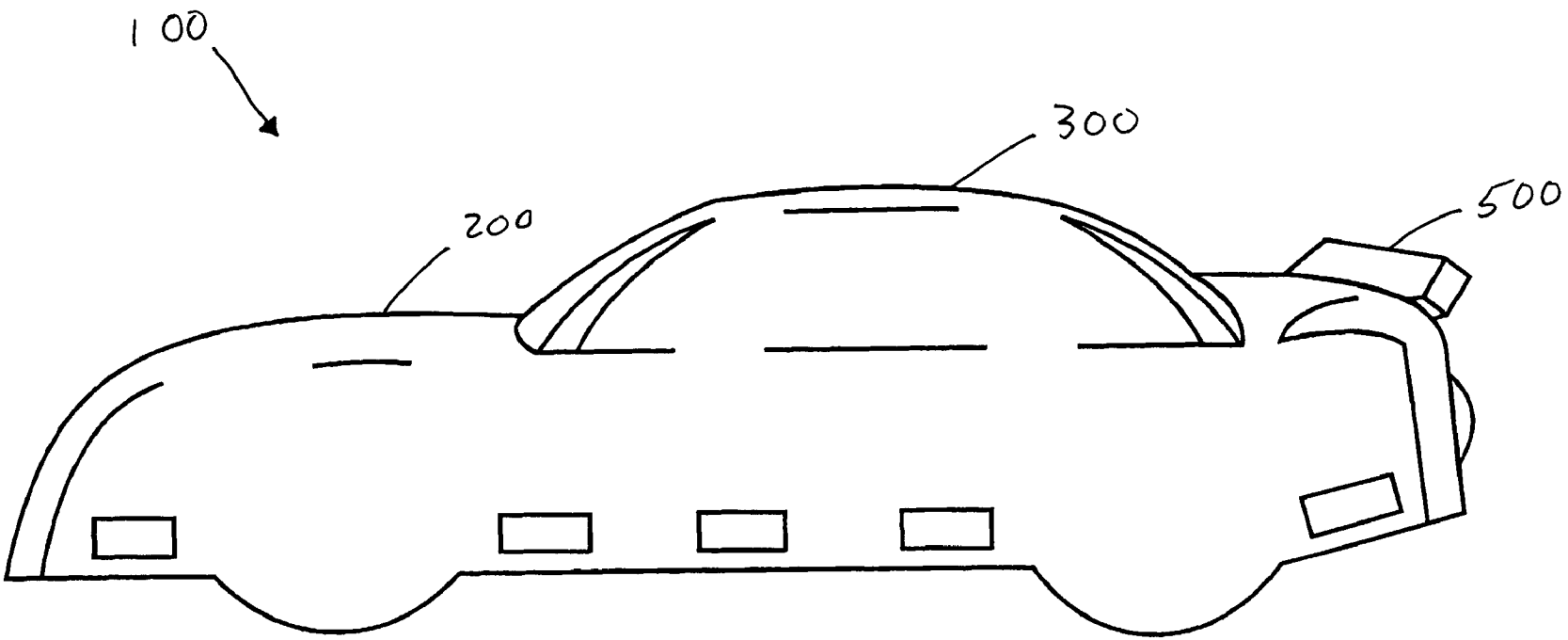
FIG. 3 is a plan view of the side of the assembled novelty hat.

As shown in FIG. 1, the novelty hat 100 in the shape of a stock car is assembled from the body member 200, the top member 300, and the bottom member 400 (not shown in FIG. 1). The spoiler member 500 is attached to the body member 200 at the rear 250 of the racecar to add a realistic feature. Some of the fasteners 600 are indicated in FIG. 1 connecting the body member 200 to the bottom member 400. In the preferred embodiment, fasteners 600 connect the body member 200 to the top member 300, the bottom member 400, and the spoiler member 500 as shown in FIGS. 1, 2, and 3. The fasteners 600 may, however, connect the members 200, 300, 400, and 500 using other quantities and locations of fasteners 600.

The members 200 and 300 of the assembled novelty hat 100 form the key elements of a racecar and particularly resemble a stock car due to the specific shape and proportions of these key elements. The top member 300 forms the roof 310, the windshield 320, the first side and second side windows 330, 340, and the rear window 350. The body member 200 forms the hood 210, the wheels 220, the first side and second side body panels 230, 240, and the rear 250 of the racecar.

Note that the novelty hat 100 provides many typical locations where sponsors and teams print their logos and racing information. Although not shown in FIG. 1, the body member 200 and the top member 300 may be printed with anything from sponsor and driver logos to cartoon figures depending on the intended consumer target.

FIG. 2 illustrates the bottom member 400 and the body member 200. The bottom member includes the aperture 410 for resting on a fan's head and a die cut perimeter 420. The perimeter 420 is shown connecting to the body member 200 by the fasteners 600.

Racecar enthusiasts will appreciate the printing capabilities of the novelty hat 100. Details like axels, wheels, drive shafts, transmissions, exhaust pipes, and other similar vehicle and engine details may be printed on the bottom member 400, giving the novelty hat 100 a realistic look and a collector's item feel. Although the vehicle details are preferred, many other printed designs may work depending on the marketing goals.

FIG. 3 illustrates the side of the novelty hat 100. The body member 200, the top member 300, and the spoiler member 500 are shown connected by unseen fasteners 600. The fasteners 600 connecting the body member 200 to the bottom member 400 are visible along the bottom of the first side body panel 230.

Note that the first side body panel 230 provides printing space for both vehicle details and racing team logos. Likewise the roof and windows can be printed with vehicle details like window nets and an image of the driver in the racecar. Preferably, all exterior surfaces would be printed with vehicle details and sponsor information giving the novelty hat 100 a realistic look and marketing capabilities.

Figure 4:
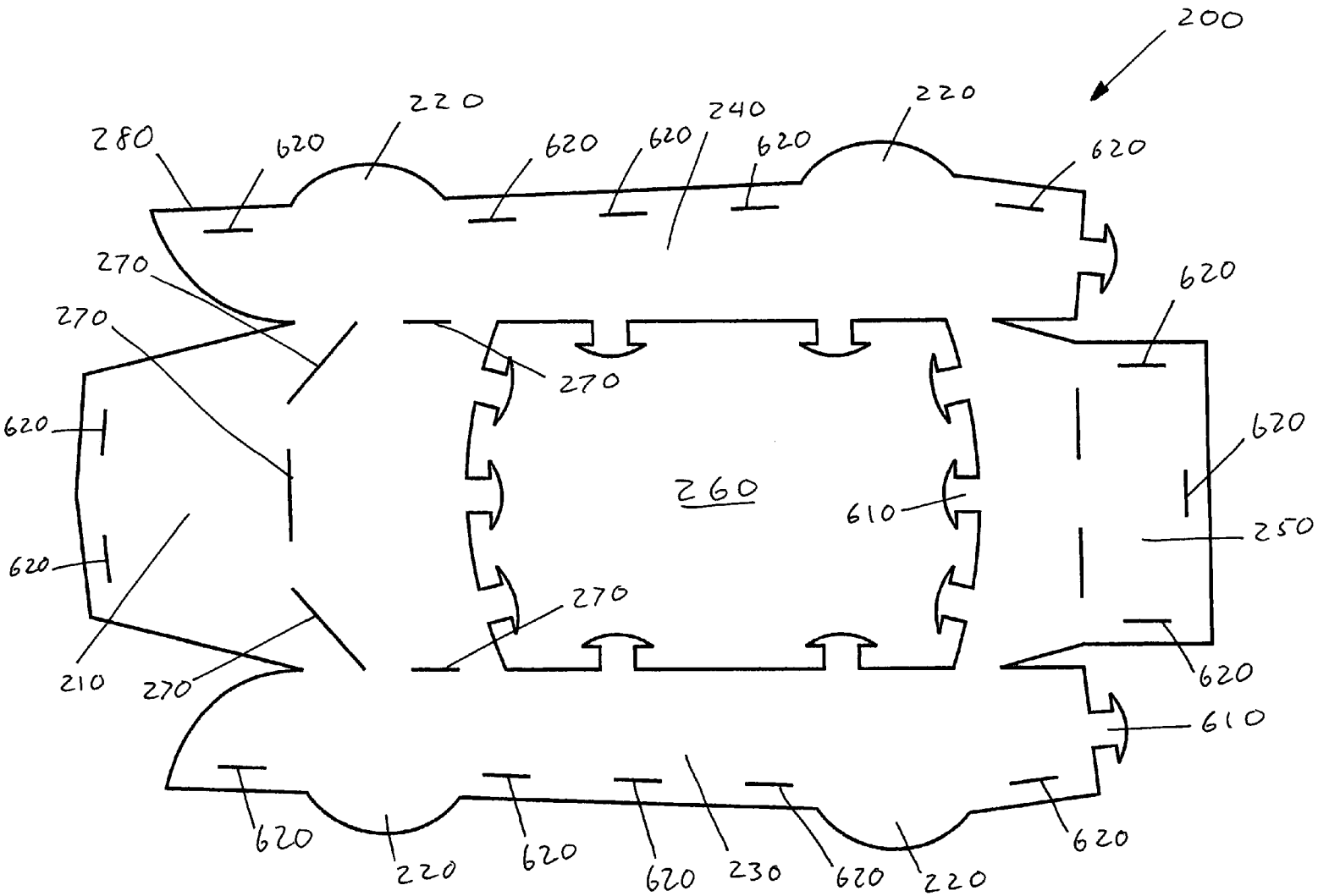
FIG. 4 is a plan view of the body member.

FIG. 4 illustrates the body member 200 and the die cut profile 280 before being assembled and connected to the other members 300 and 400. The body member 200 includes four major pieces: the hood 210, the first side body panel 230, the second side body panel 240, and the rear 250. The first side body panel 230 and the second side body panel 240 both have two wheels 220 each for vehicle detail. Although, the wheels 220 are preferred, many different sizes, locations, and even the absence of wheels would work. From the approximate center of the body member 200, foam has been removed to create an aperture 260. The body member 200 also has numerous folding slits 270, which are deliberately placed to help the foam fold and bend in particular places when the novelty hat 100 is assembled.

FIG. 4 also illustrates the two parts of the fastener 600: the male part 610 and the female part 620. The male parts 610 extending from the back of the first side body panel 230 and the second side body panel 240 connect with two female parts 620 on the rear 250 of the body member 200. The male parts 610 extending into the aperture 260 connect with the female parts 620 on the top member 300.

The female parts 620, shown primarily located near the exterior of the body member 200, connect with male parts 610 from members 200, 400. In the preferred embodiment, the positioning of the male parts 610 and the female parts 620 of the fasteners 600 are strategically placed to bend and fold the flat members 200 and 300, in the shape of a stock car. The fasteners 600 may, however, be modified in their location and number to facilitate the novelty hat 100 resembling other racing vehicle shapes.

Figure 5:
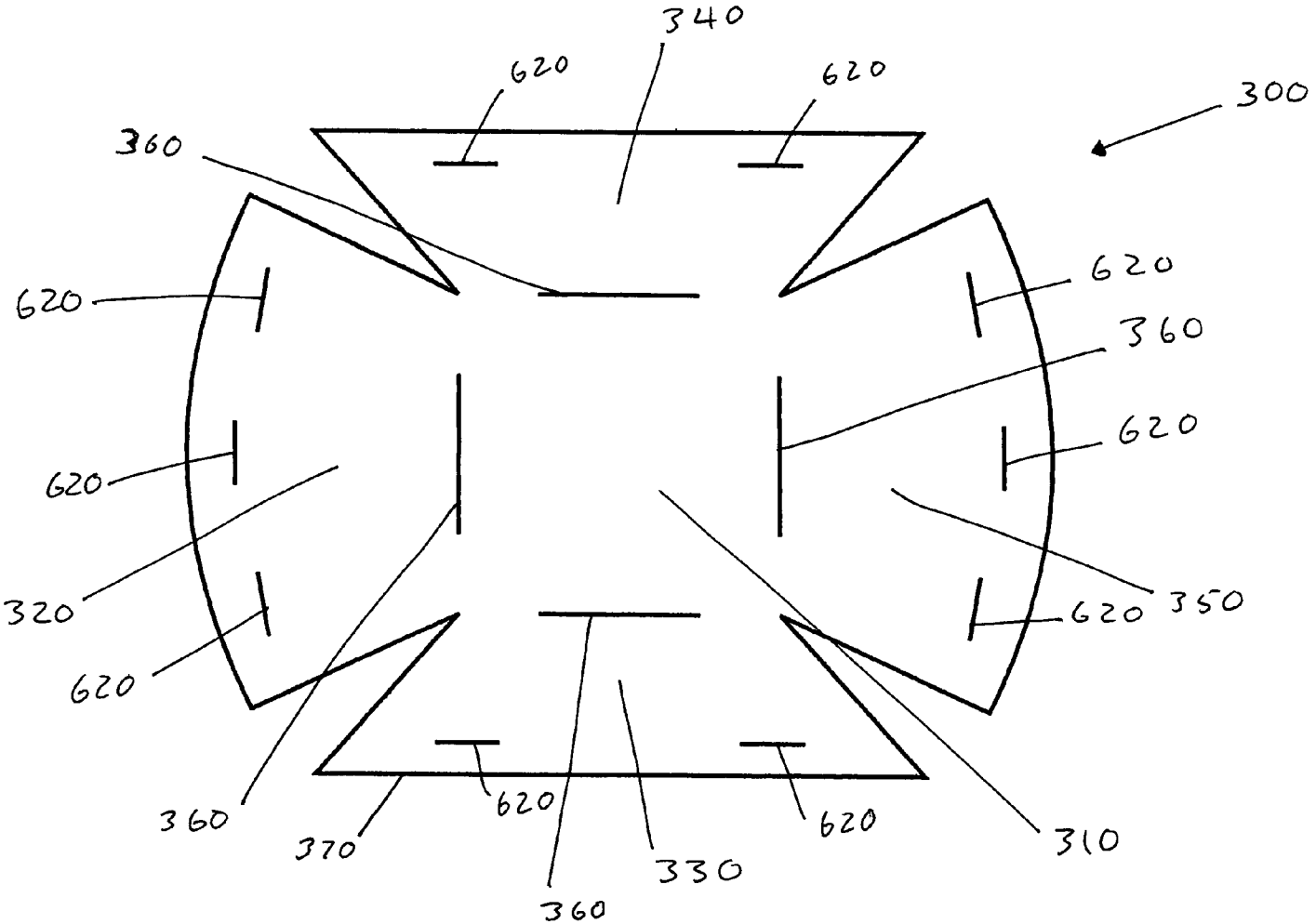
FIG. 5 is a plan view of the top member.

FIG. 5 illustrates the top member 300 and the die cut profile 370 before the top member 300 is assembled and connected to the body member 200. The female parts 620, located near the profile 370 of the top member 300, fasten to the male parts 610 extending into the aperture 260 of the body member 200 shown in FIG. 4. Like the body member 200, the top member has folding slits 360 to help the top member 300 fold or bend into the shape of the roof 310, the windshield 320, the first side window 330, the second side window 340, and the rear window 350.

Figure 6:
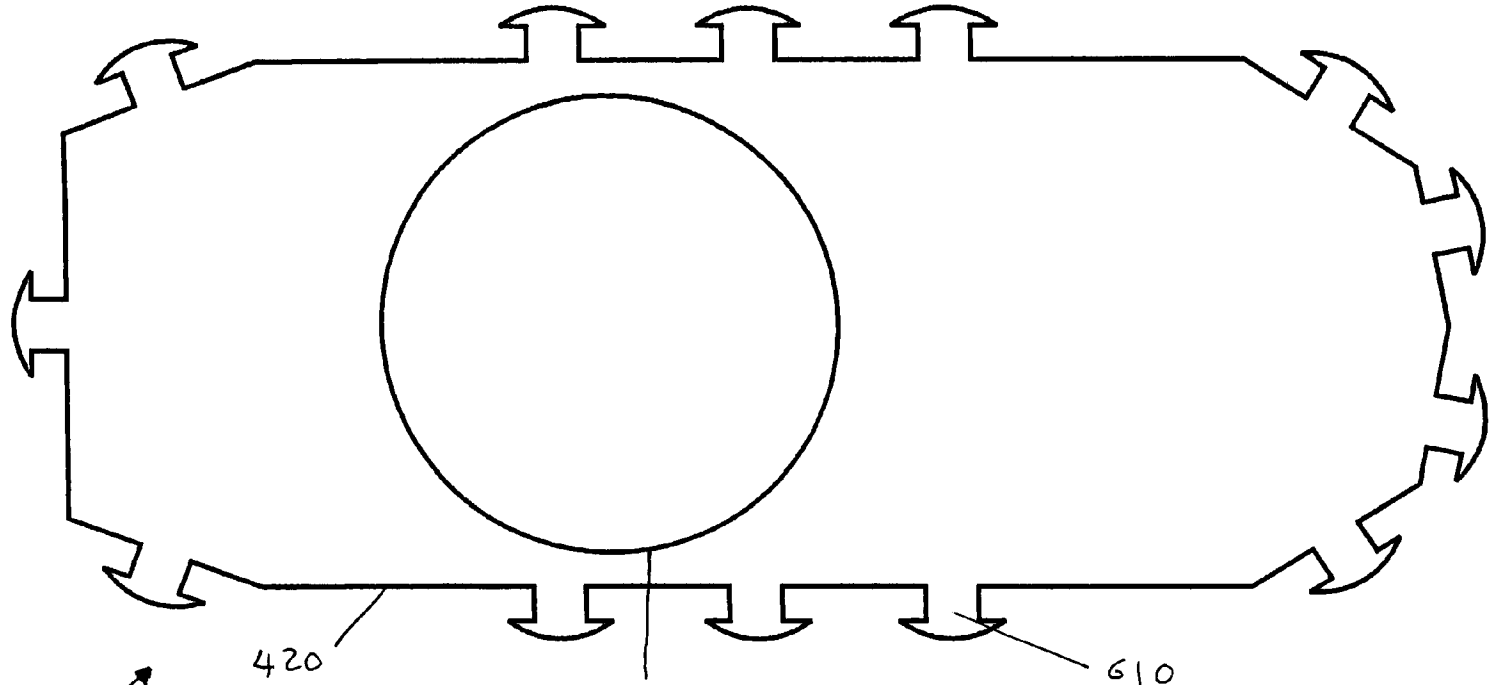
FIG. 6 is a plan view of the bottom member.

FIG. 6 illustrates the bottom member 400 and the die cut profile 420 before the bottom member 400 is assembled and connected to the body member 200. Extending form the profile 420 of the bottom member 400 are male parts 610 of the fasteners 600. The male parts 610 of the bottom member 400 connect with the female parts 620 of body member 200. The bottom member 400 also includes the aperture 410, which provides for resting the assembled novelty hat 100 on a fan's head. Although, the preferred embodiment employs a circular aperture 410, any sized or shaped opening or even simple slits would work provided that a sufficient opening is created in the bottom member 400, capable of admitting at least the top of a fan's head.

Figure 7:
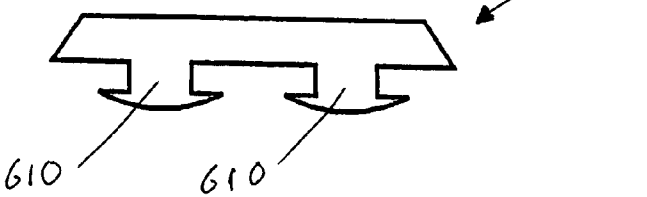
FIG. 7 is a plan view of the spoiler.

FIG. 7 illustrates the spoiler member 500 and the male parts 610 that connect the spoiler member 500 to the body member 200 as shown in FIG. 1 and FIG. 3. In the preferred embodiment the spoiler member 500 is shaped as shown in FIG. 7 to mimic the spoiler found on a stock car. The spoiler member 500 may, however, take the shape of many other spoilers depending on the racing vehicle chosen for the novelty hat 100.

Figure 8:
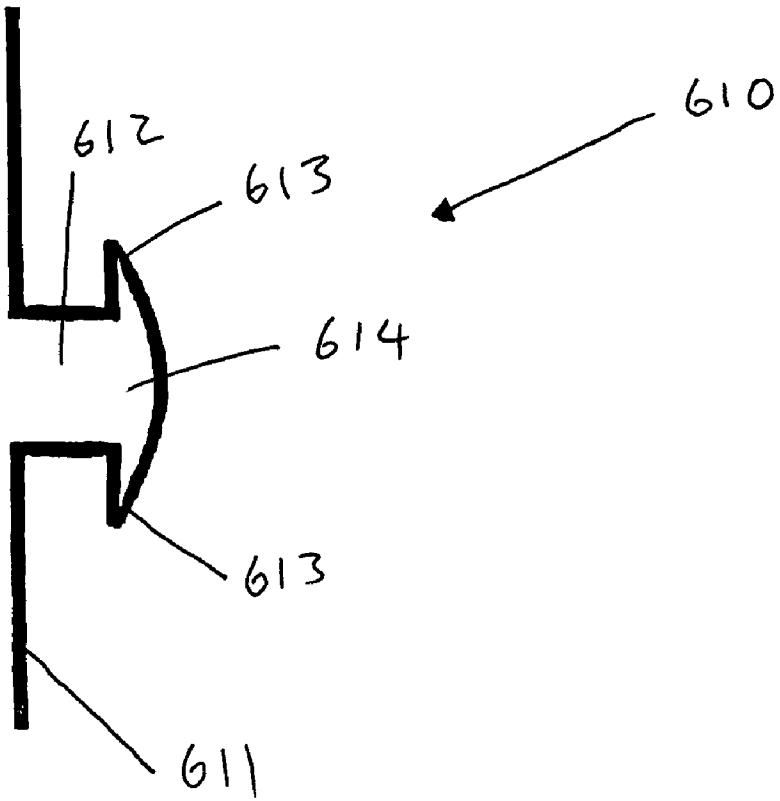
FIG. 8 is a plan view of the fastener.

FIG. 8 illustrates the male part 610 of the fastener 600. Extending from the profile 611, representing the profile of one of the other members 200, 400 or 500, the projection 612 extends the distance approximately equal to the thickness of one of the members 200, 300, 400, or 500 before being crowned by the locking tip 614. In the preferred embodiment, the locking tip 614 has a gently curved face with two extensions 613. The extensions 613 and the projection 612 lend the male part 610 a generally "T" shape.

When connecting one member to another, the male part 610 is inserted through the female part 620. The projection 612 extends from one side of the member being connected, through the opening of the female part 620, and allows the locking tip 614 to protrude out of the female part 620 on the opposite side. Once the locking tip 614 has passed through the female part 620, the extensions 613 expand beyond the opening of the female part 620 such that the locking tip 614 will not pull back through the female part 620.

Although the preferred embodiment discloses the use of the male and female parts 610, 620 for connecting the member to one another, the connection may be accomplished with other fastening elements known to those in the art such as, but not limited to, hook and loop, buttons and etc. More permanent fastening means such as sewing and chemically bonding the members together could also be used.

Figure 9:
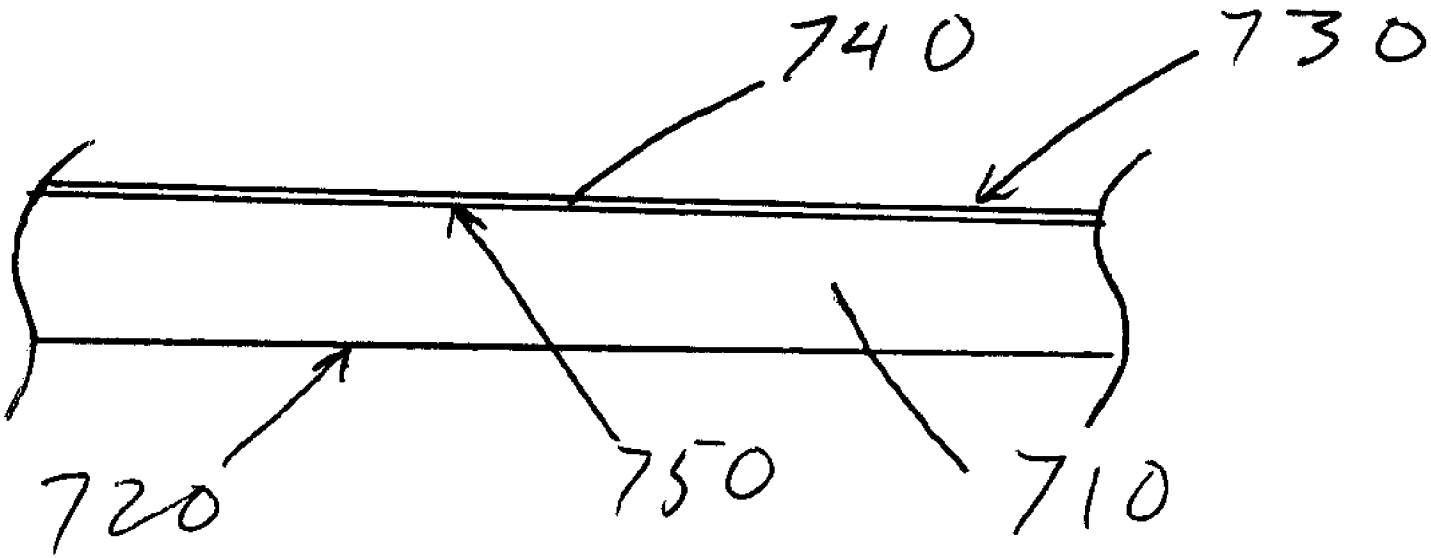
FIG. 9 is a cross sectional view of a member of the novelty hat.

FIG. 9 illustrates an edge view or cross sectional view of any of the flat members used to assemble the novelty hat 100. For example, members 200, 300, and 400 will be composed of a foam rubber 710 and in the preferred embodiment a laminate 740 will be attached to the surface 750 of the foam rubber 710. The laminate 740 will be attached to the surface 750 of the foam rubber 710 by adhesives or other means known to those of skill in the art. The foam rubber 710 may be composed of other materials besides foam rubber so long as the flat members are flexible, shapeable, and perform within the scope of the invention.

In the preferred embodiment, detailed printing will be placed on the surface 730 of the laminate 740. The surface 730 will become the exterior surface of the novelty hat 100 while the surface 720 will become the unseen, inside surface of the assembled novelty hat 100.

Although in the preferred embodiment, the laminate 740 is only applied to the surface 750 and not to the surface 720, the laminate 740 may, however, be applied to both surfaces 720 and 750. It will be obvious to one of ordinary skill in the art that laminates could be used to cover all exposed surfaces, including the edge surfaces, of the members 200, 300, and 400. It will also be obvious to one of ordinary skill that by applying laminates and/or printing on both surfaces 720 and 750, the novelty hat 100 would be reversible with different printed designs on the inside and outside surfaces of the assembled novelty hat 100.

The preferred embodiment includes the use of a cloth laminate for the laminate 740 in FIG. 9. The cloth laminate allows for photo quality printing and on the surface 730 and provides the novelty hat 100 with a quality finished appearance. It would be obvious to one of ordinary skill in the art that other laminates such as a thin layer of foam, plastic or other suitable material could be used within the scope of the present invention.

The foam rubber 710 may also be used without laminates. In this embodiment, detailed designs may be printed directly on the surface 750 and/or on surface 720 of the foam rubber 710 before assembly of the novelty hat 100.

It will be apparent to those skilled in the art that various modifications and variations can be made in the novelty hat of the present invention without departing from the spirit and scope of the invention. Thus, it is intended that the present invention cover modifications and variations of this invention provided they come within the scope of the appended claims and their equivalents.

What is claimed is:

1. A novelty hat in the shape of an automobile comprising:

a separate substantially planar top member having a front portion, a rear portion, and a first side portion and a second side portion;

a separate substantially planar bottom member having an aperture; and a separate substantially planar body member;

wherein said top member is connectable by fastener means to said body member and said body member is connectable by fastener means to said bottom member to form said novelty hat in the shape of said automobile, the front portion of said top member forms a front windshield of said automobile when the front portion is connected to said body member.

2. A novelty hat according to claim 1, wherein said automobile is a racecar.

3. A novelty hat according to claim 1, further comprising a substantially planar spoiler member being connectable to said body member.

4. A novelty hat according to claim 1, wherein said automobile is a truck.

5. A novelty hat according to claim 1, wherein said members comprise a foam layer and at least one laminated surface.

6. A novelty hat according to claim 5, wherein said at least one laminated surface is a cloth laminate.

7. A novelty hat according to claim 1, wherein the rear portion of said top member forms a rear window of said automobile when the rear portion is connected to said body member.

8. A novelty hat according to claim 7, wherein the first side portion and the second side portion of said top member form side windows of said automobile when the first side portion and the second side portion are connected to said body member.

9. A novelty hat, in the shape of an automobile comprising:

a separate substantially planar top member having a front portion, a rear portion, and a first side portion and a second side portion;

a separate substantially planar bottom member having an aperture; and a separate substantially planar body member;

wherein said top member is connectable by fastener elements to said body member and said body member is connectable by fastener elements to said bottom member to form said novelty hat in the shape of said automobile, the front portion of said top member forms a front windshield of said automobile when the front portion is connected to said body member.

10. A novelty hat according to claim 9, wherein each of said fastener elements comprises a male part and a female part.

11. A novelty hat according to claim 10, wherein the male part includes a protrusion and a locking tip and the female part includes an opening for receiving the male part.

12. A novelty hat according to claim 11, wherein the locking tip is substantially arrowhead shaped.

13. A novelty hat according to claim 11, wherein the protrusion and the locking tip substantially form a "T" shape.

14. A novelty hat in the shape of an automobile comprising:

a separate substantially planar top member having a front portion, a rear portion, and a first side portion and a second side portion;

a separate substantially planar bottom member having an aperture; and a separate substantially planar body member;

wherein said top member is connectable to said body member and said body member is connectable to said bottom member to form said novelty hat in the shape of said automobile and wherein said body member includes a hood portion, a trunk portion, and a first door side portion and a second door side portion and wherein the hood portion, the trunk portion and the first door side portion and the second door side portion connect to said bottom member to form a hood, a trunk, and two sides of said automobile.

15. A method of forming a novelty hat, the method comprising the steps of:

forming a substantially flat top panel having a substantially flat first printable surface;

forming a substantially flat bottom panel having an aperture and a substantially flat second printable surface;

forming a substantially flat body panel, the body member including a substantially flat third printable surface;

printing a predetermined pattern on the at least one of the first printable surface, the second printable surface, and the third printable surface;

packaging the top panel, the bottom panel, and the body panel such that the first printable surface, the second printable surface, and the third printable surface are substantially parallel;

wherein the top panel, the bottom panel, and the body panel are connectable to form a automobile shaped novelty hat.

16. The method according to claim 15, further comprising the step of:

forming the top panel, the bottom panel, and the body panel from a foam having a substantially consistent thickness; and applying a laminate surface to at least one of the first printable surface, the second printable, and the third printable surface prior to printing.

17. The method according to claim 16, wherein the laminate surface is a cloth laminate.

18. The method according to claim 15, further comprising the step of:

printing at least one of a windshield, a rear window, a side window, and a roof on the first printable surface.

19. The method according to claim 15, further comprising the step of:

printing at least one of a wheel, a door, a hood, a trunk, a bumper on the third printable surface.

* * * * *